United States Patent [19]

Speller, Sr.

[11] Patent Number: 4,858,289

[45] Date of Patent: Aug. 22, 1989

[54] DIMPLING AND RIVETING APPARATUS

[75] Inventor: Thomas H. Speller, Sr., Buffalo, N.Y.

[73] Assignee: Gemcor Engineering Corp., Buffalo, N.Y.

[21] Appl. No.: 492,041

[22] Filed: May 6, 1983

[51] Int. Cl.[4] ..... B21J 15/12

[52] U.S. Cl. ..... 29/34 B; 29/243.53; 29/796; 227/61; 227/69; 227/99

[58] Field of Search ..... 29/431, 796, 509, 522, 29/526 R, 243.53, 26 A, 50, 56.5, 56.6, 33 K, 34 B; 227/61, 69, 99

[56] References Cited

U.S. PATENT DOCUMENTS

| | | | |
|---|---|---|---|
| 2,216,403 | 10/1940 | Oeckl et al. . | |
| 3,557,442 | 1/1971 | Speller | 29/243.53 X |
| 3,828,421 | 8/1974 | Erlichman | 29/526 X |
| 4,270,253 | 6/1981 | Herb et al. | 29/26 A |
| 4,445,264 | 5/1984 | Banerian | 29/526 R X |

*Primary Examiner*—Joseph M. Gorski

*Attorney, Agent, or Firm*—Christel, Bean & Linihan

[57] ABSTRACT

Dimpling and riveting a workpiece wherein the workpiece is clamped, the dimpling, drilling and riveting occur sequentially while the workpiece is clamped, and the workpiece is heated prior to dimpling. During clamping a pressure foot force is applied to one side of the workpiece, and during dimpling a force is applied to the opposite side causing slight movement of the workpiece against the pressure foot force. The dimpled recess in the workpiece is about the shape of a truncated cone and a rivet-receiving hole is drilled through the workpiece in the recess. To provide a fluid-tight seal, the minor diameter of the truncated cone is made slightly greater than the diameter of the rivet-receiving hole thereby providing an annular step between the hole and the outwardly diverging wall of the dimpled recess. During upsetting of the rivet the workpiece material is compressed radially around the annular step to provide a fluid-tight seal between rivet and workpiece. A pressure foot contacts one side of the workpiece, a biasing arrangement connected to the pressure foot and to the apparatus frame applies force to the pressure foot, a clamp member contacts the opposite side of the workpiece and a mechanism connected to the clamp member and to the frame moves the clamp member into contact with the workpiece and moves the workpiece into contact with the pressure foot and then moves the clamp and pressure foot with the workpiece therebetween against the pressure foot force during dimpling.

7 Claims, 4 Drawing Sheets

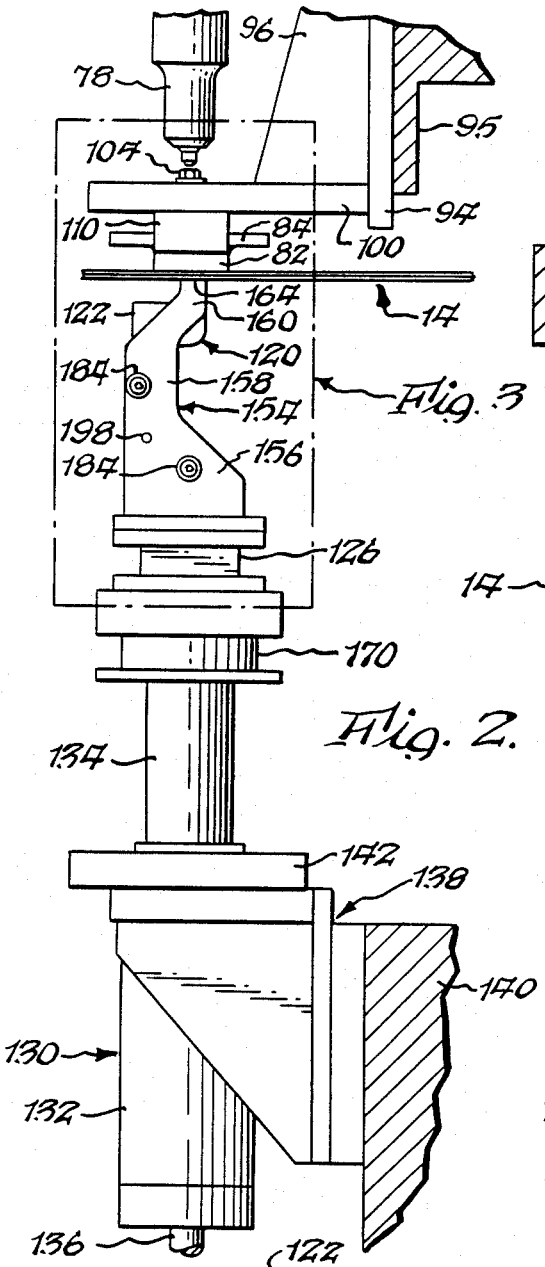
Fig. 3
Fig. 2.
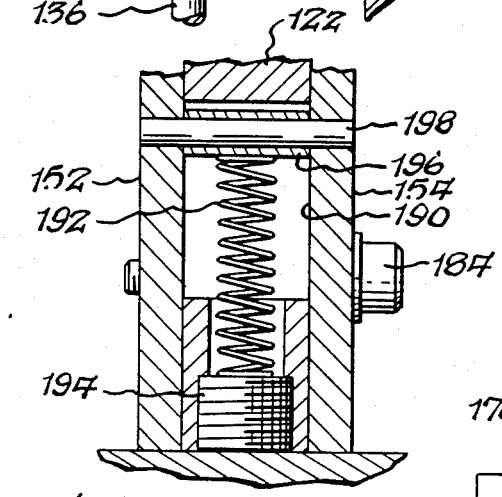
Fig. 4.
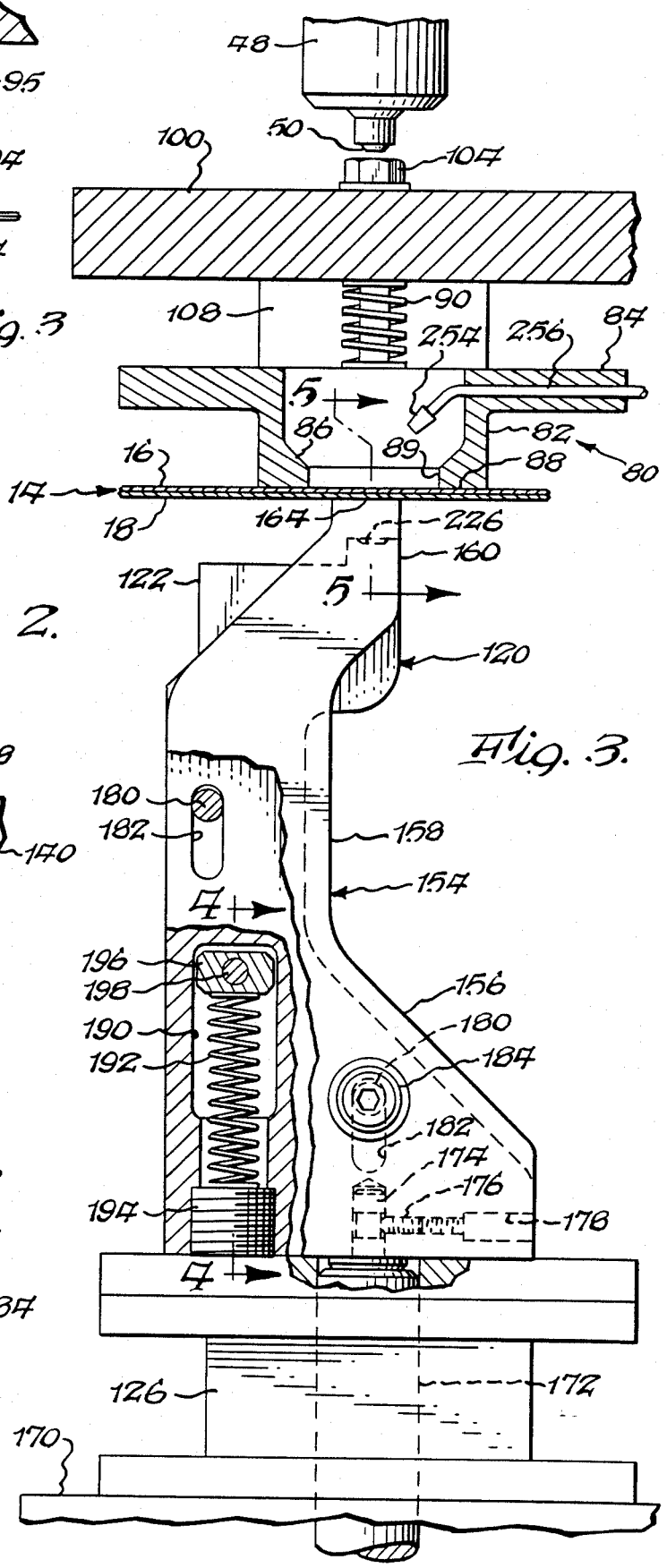
Fig. 3.

Fig. 13.
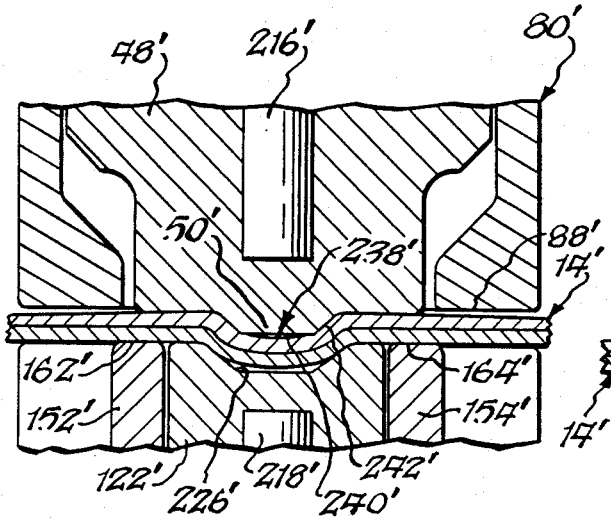
Fig. 14.
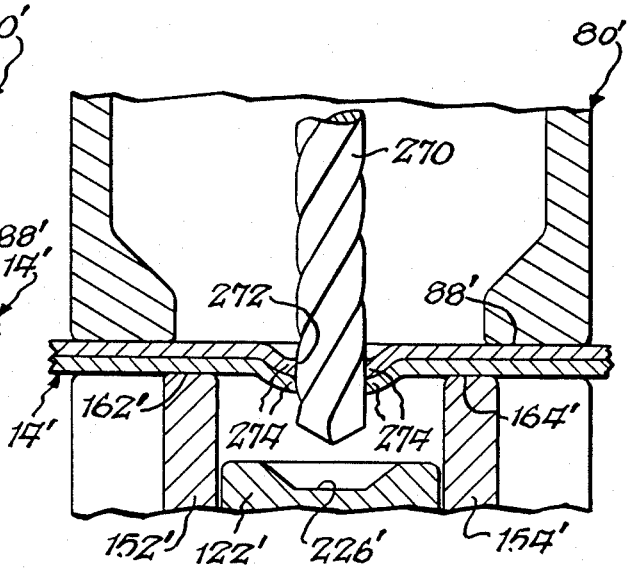
Fig. 15.
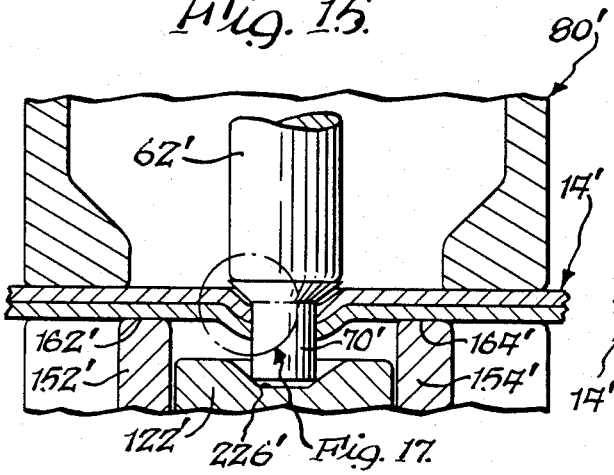
Fig. 16.
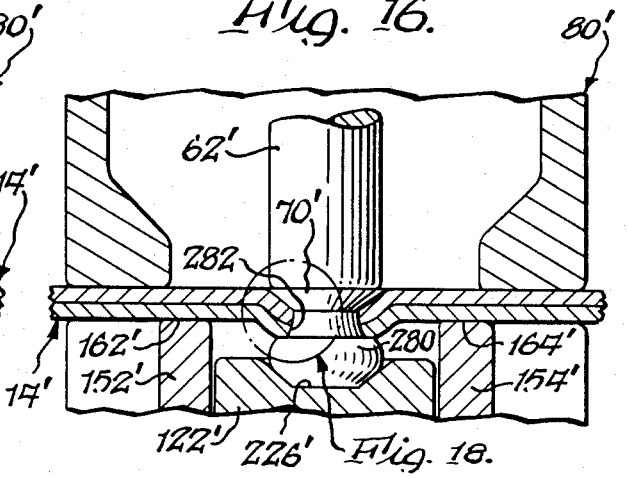
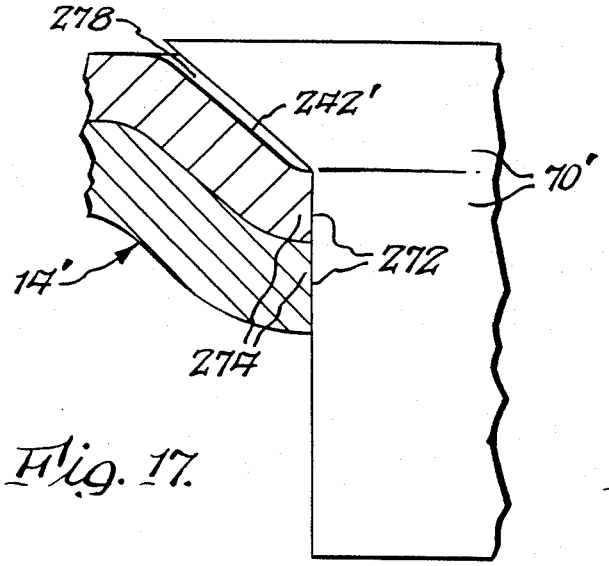
Fig. 17.
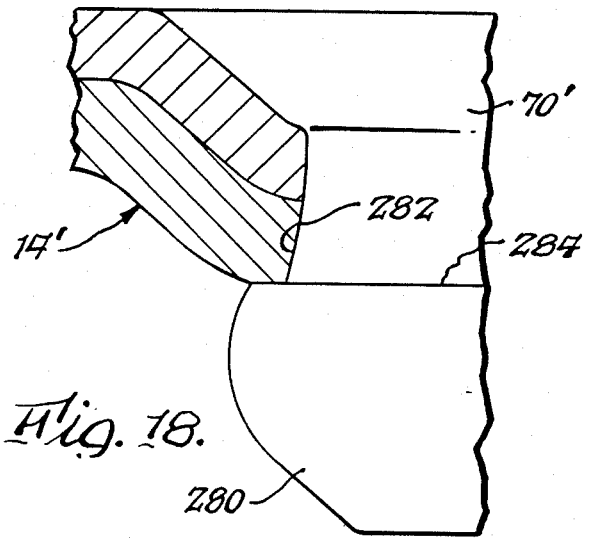
Fig. 18.

DIMPLING AND RIVETING APPARATUS

This invention relates to the art of dimpling and riveting, and more particularly to a new and improved method and apparatus for sequentially dimpling, drilling and riveting a workpiece.

One area of use of the present invention is in making dimpled and riveted joints between relatively thin metal sheets to provide a smooth, flush outer surface and, when desired, to provide a fluid-tight seal between the rivet and workpiece, although the principles of the invention can be variously applied. In dimpling a metal workpiece for subsequent riveting, it is important to locate and form the dimple in an accurate manner, and to form the dimple without cracks and distortion on the workpiece. In addition, there are situations where it is necessary to accomplish the foregoing and also provide a fluid-tight seal between the rivet and workpiece. An example of the foregoing is riveting wing sections of an aircraft wherein the hollow region between riveted sheets is used to store fuel and it is desired that the riveted joints be fluid-tight.

SUMMARY OF THE INVENTION

It is, therefore, a primary object of this invention to provide a new and improved method and apparatus for dimpling, drilling and riveting a workpiece.

It is a further object object of this invention to provide such a method and apparatus which provides a fluid-tight seal in the riveted joint between the rivet and the workpiece.

It is a further object of this invention to provide such method and apparatus which locates and forms each dimple in an accurate manner.

It is a further object of this invention to provide such method and apparatus which forms each dimple without cracks and distortion in the workpiece.

It is a more particular object of this invention to provide such method and apparatus which prevents relative stretching of metal sheets during dimple formation.

The present invention provides a method and apparatus for dimpling and riveting a workpiece wherein the workpiece is clamped and the dimpling, drilling and riveting are performed sequentially while the workpiece is clamped. In most instances the workpiece is heated in the area of the dimple and prior to dimpling. The clamping includes applying a biasing force to one side of the workpiece, and during dimpling a force is applied to the opposite side of the workpiece in a manner causing movement of the workpiece a small distance during dimpling and against the biasing force. The dimpling forms a recess in the workpiece which is in the general shape of a truncated cone, and the drilling provides a rivet-receiving hole through the workpiece in the recess. When it is desired to provide a fluid-tight seal, the rivet-receiving hole has a diameter less than the minor diameter of the truncated cone thereby providing an annular step or ledge extending between the hole and the outwardly diverging wall of the dimpled recess. During upsetting of the rivet there is a radial compression of the workpiece material in the region of the annular step thereby providing a fluid tight seal between the rivet and the workpiece. The apparatus for providing such fluid-tight seal is characterized by the end of one dimpling anvil or tool having the shape of a truncated cone and by the drill having a diameter less than the minor diameter of that truncated cone. The apparatus further includes a pressure foot having a surface adapted to contact one side of the workpiece, biasing means connected to the pressure foot and to the apparatus frame for applying a biasing force to the pressure foot, a clamp member having a surface adapted to contact the opposite side of the workpiece and motive means connected to the clamp member and to the frame for moving the clamp member into contact with the workpiece and moving the workpiece into contact with the pressure foot and then moving the clamp and pressure foot with the workpiece therebetween against the force of the biasing means during dimpling. As a result, during dimpling the workpiece sheets move uniformly with the machine parts and thus stretch together during dimpling rather than stretching relative to each other.

The foregoing and additional advantages and characterizing features of the present invention will become clearly apparent upon a reading of the ensuring detailed description together with the included drawing wherein:

BRIEF DESCRIPTION OF THE DRAWING FIGURES

FIG. 2 is a fragmentary side elevational view of the apparatus of FIG. 1;

FIG. 3 is an enlarged elevational view taken within the field of view indicated in broken lines in FIG. 2;

FIG. 4 is a fragmentary sectional view taken about on lines 4—4 in FIG. 3;

FIG. 13 is a fragmentary sectional view on an enlarged scale of a modified portion of the apparatus of FIG. 1 and illustrating the method and apparatus according to another aspect of the present invention during formation of a dimpled recess in the workpiece;

FIG. 14 is a view similar to FIG. 13 illustrating the drilling of a rivet receiving hole through the workpiece in the rivet-receiving recess according to the present invention;

FIG. 15 is a view similar to FIG. 13 illustrating the method and apparatus according to the present invention subsequent to inserting a rivet in the receiving hole and at the beginning of the rivet upset step;

FIG. 16 is a view similar to FIG. 15 at the end of the rivet upset step;

FIG. 17 is an enlarged fragmentary sectional view taken within the field of view indicated in broken lines in FIG. 15; and FIG. 18 is an enlarged fragmentary sectional view taken within the field of view indicated in broken lines in FIG. 16.

DETAILED DESCRIPTION OF THE ILLUSTRATED EMBODIMENT

Figure 1:
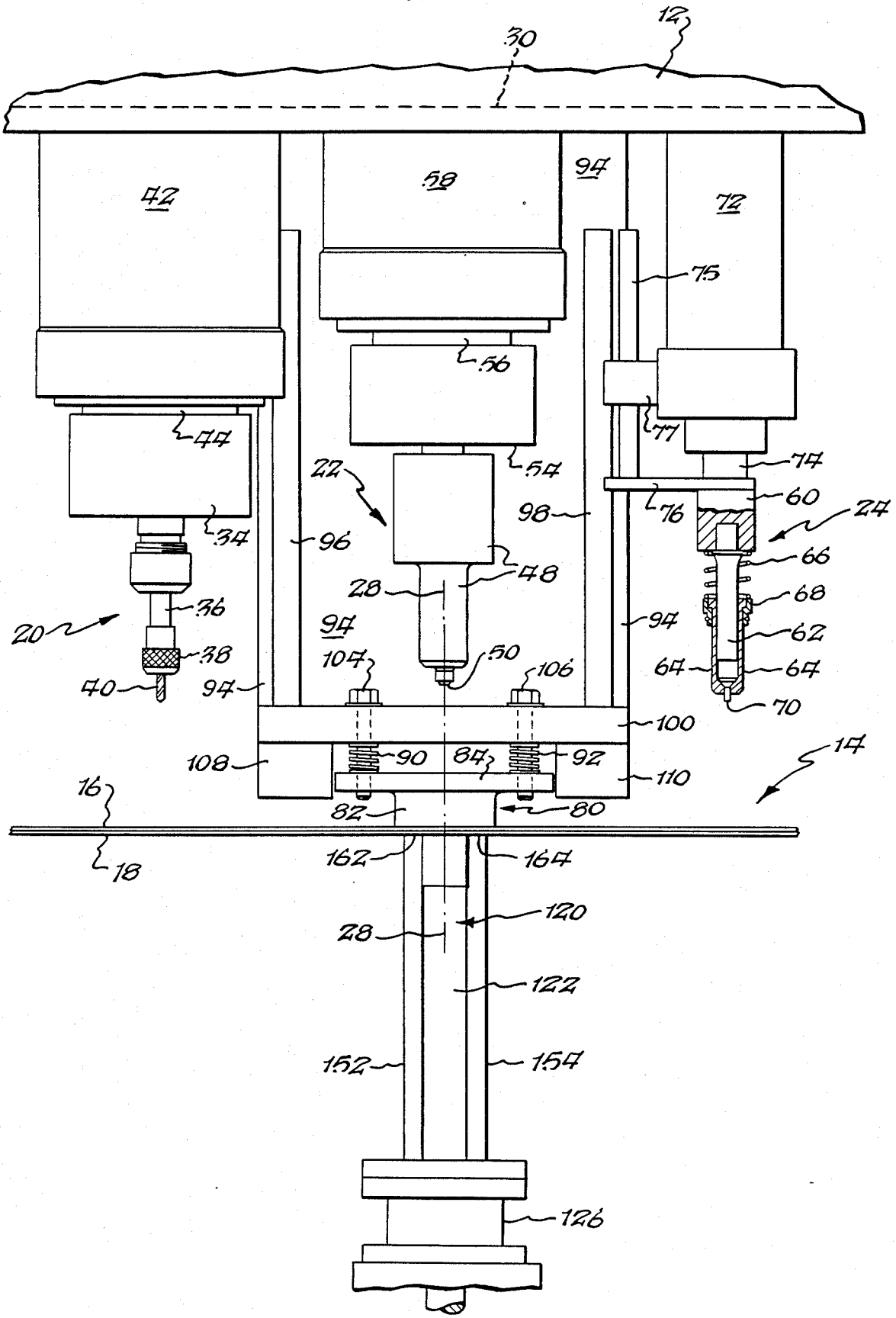
FIG. 1 is a fragmentary front elevational view of apparatus for dimpling, drilling and riveting a workpiece according to the present invention.

Referring to FIG. 1, the apparatus according to the present invention comprises a frame having an upper portion designated 12, and in the arrangement shown a workpiece generally designated 14 comprising sheets 16, 18 is held or supported in a suitable manner at a location below the frame portion 12. In the apparatus shown, workpiece 14 is disposed substantially in a horizontal plane during the heating, dimpling, drilling and riveting operations performed by the apparatus. The apparatus further comprises means carried by the frame for sequentially dimpling, drilling and riveting the workpiece 14. In particular, the apparatus includes a drill generally designated 20, a dimpling tool generally designated 22 and a rivet inserting and forming tool generally designated 24. The tools are movably carried by frame portion 12 for movement into and out of alignment with a dimpling, drilling and riveting axis generally designated 28 which is disposed substantially perpendicular to the plane of workpiece 14. In the arrangement shown, the axis 28 is substantially vertical. The tools 20, 22 and 24 are carried by a slide member (not shown) which is supported in and reciprocable along a track 30 provided in the frame portion 12, and the tools 20, 22 and 24 thus are movable with the slide member and into and out of alignment with the dimpling, drilling and riveting axis 28. To this end the slide member is operatively connected to suitable motive means (not shown) for moving the slide, for example a motor and rack and pinion arrangement or an hydraulic cylinder. In addition, each tool 20, 22 and 24 is movable individually toward and away from workpiece 14 along the dimpling, drilling and riveting axis 28 by suitable means such as a hydraulic or pneumatic cylinder carried by the slide movable in frame portion 12. In particular, drill 20 comprises a motor, which can be a hydraulic motor in a motor housing 34 and which has an output shaft 36, a coupling or chuck assembly 38 and a drill bit 40. The motor in housing 24 operates to rotate shaft 36 and hence the drill bit 40. The drill is movable toward and away from workpiece 14 by means of a cylinder 42, which can be hydraulic or pneumatic, fixed at one end to the slide supported in track 30 and having a rod 44 extending from the opposite end and fixed to the motor housing 34. Dimpling tool 22 comprises an anvil body portion 48 and a male dimpling tool or die 50 on the end thereof which will be described in further detail presently. The tool 22 also includes a housing 54 and is movable toward and away from workpiece 14 by means of a cylinder 58 fixed at one end to the slide supported in track 30 and having a rod 60 at the other end fixed to the dimpling tool housing 56.

The rivet inserting and forming tool 24 includes a body 60, and an anvil 62 extending downwardly into a pair of rivet receiving fingers 64 biased by a spring 66 extending between body 60 and a collar 68 surrounding the fingers 64, all of which is conventional in the riveting machine art. The individual rivets, one of which is designated 70 in FIG. 1, are commonly fed to the tool 24 by passing them downwardly from a bin through a feed tube and then laterally one by one into the rivet receiving fingers which support each rivet and insert it through a hole in the workpiece to be riveted. Passage of the rivets downwardly through a feed tube may be by gravity alone or by air pressure against the rivet moving downwardly through the feed tube, all in a manner which is known in the riveting machine art. Tool 24 is movable toward and away from workpiece 14 by means of an hydraulic or pneumatic cylinder 72, one end of which is fixed to the slide supported in track 30 and the other end of which has a rod 74 connected to the body 60. A guide rod 75 disposed generally parallel to the longitudinal axis of cylinder 72 is fixed at one end to an arm 76 extending laterally outwardly of body 60 and is movably received in an opening in an arm 77 extending laterally outwardly of cylinder 72.

The apparatus of the present invention further comprises means for clamping the workpiece continuously during dimpling, drilling and riveting thereof. In particular, the clamping means comprises a pressure foot generally designated 80 in FIG. 1 and having a surface adapted to contact one side of the workpiece 14, i.e. the upper surface of the workpiece as viewed in FIG. 1. Pressure foot 80 is in the form of a hollow bushing having a side wall 82, and an outwardly extending flange 84 adjacent the end of wall 82 as viewed in FIG. 1. In a preferred form of bushing 80, side wall 82 is annular providing a generally cylindrical body of bushing 80, and flange 84, is annular of washer-like form, disposed in a plane substantially perpendicular to the longitudinal axis of the annular body portion 82. The lower end of wall 82 as viewed in FIG. 1, i.e. the end facing workpiece 14, is formed to include an enlargement 86 extending inwardly as shown in FIG. 3. Enlargement 86 likewise preferably is of annular form, and the lower end face of wall 82 and the surface of enlargement 86 define a flat annular surface 88 for contacting workpiece 14. The inner surface 89 of wall portion 86 defines an opening 89 which preferably is circular in shape. The diameters of the inner surface of wall 82 and opening 89 of pressure foot 80 are of a size permitting the work-contacting parts of tools 20, 22 and 24 to pass therethrough for operating on workpiece 14.

The clamping means further comprises biasing means operatively connected between pressure foot 80 and the apparatus frame for applying a biasing force to the pressure foot. In other words, the biasing means may be viewed as force applying means operatively connected to pressure foot 80 for enabling the pressure foot to apply a counter force when the workpiece is urged or forced against the pressure foot in a manner which will be described. The biasing or force applying means comprises a pair of pre-tensioned coil springs 90, 92 shown in FIG. 1 each having one end contacting the pressure foot flange 84 and the other end contacting a portion of the apparatus frame. In particular, a frame member 94 is fixed at one end to the upper frame portion 12 as viewed in FIG. 1 and depends therefrom so as to be disposed generally vertically and is located rearwardly of the path of sideways movement of the tools 20, 22 and 24. Frame member 94 is further supported by rear frame portion 95 as shown in FIG. 2. A pair of spaced apart, generally parallel frame side wall members 96, 98 extend from member 94 at substantially right angles to the plane of member 94 and in a direction toward the sideways path of tools 20, 22 and 24 as viewed in FIG. 1 but terminating at a location so as not to interfere with the tool travel. A bottom frame member 100 is fixed to the rear frame member 94 and to the side frame members 96, 98 and is disposed generally parallel to the plane of workpiece 14. The pre-tension force applying means further comprises adjusting means in the form of a pair of screws 104, 106 which extend through bores in the bottom frame member 100, axially through corresponding springs 90 and 92 and thread into bores at diametricaly opposite locations on the pressure foot flange 84. The heads of the adjusting screws 104, 106 are accessible at the top surface of bottom frame 100 as shown in FIG. 1 to permit convenient adjustment of the forces provided by the springs 90, 92. A pair of guide members 108, 110 are fixed to and depend from the bottom frame member 100 and are located on opposite sides of pressure foot flange 84 for guiding movement of pressure foot 80 when the workpiece is forced against pressure foot 80 and the force of springs 90, 92 in a manner which will be described.

Thus, pre-tensioned springs 90, 92 provide a force against upward movement of pressure foot 80 as viewed in FIG. 1. This pre-tension force is adjustable by means of the screws 104 and 106 associated with the springs 90 and 92 respectively. By way of example, in an illustrative apparatus, the pressure foot force, i.e. the pre-tension, provided by springs 90, 92 is from about 300 pounds to about 700 pounds. As an alternative to springs 90, 92 the apparatus could be provided with a pair of hydraulic or pneumatic cylinders arranged with the housings thereof fixed to the apparatus frame 12 and with the rods thereof connected to pressure foot flange 84 at about the same location as adjusting screws 104, 106. The pressure foot force then would be determined and could be adjusted by controlling the fluid pressure in the cylinders.

The clamping means further comprises a ram and clamp arm structure operatively associated with the opposite side of workpiece 14, i.e. the lower side as viewed in FIG. 1. In particular there is provided a ram generally designated 120 in FIGS. 1–3 mounted for movement toward and away from one side of workpiece 14. The ram has an upper portion or anvil 122 as viewed in FIGS. 1–3 and which is provided with a formation on the top end thereof for contacting the workpiece 14 during dimpling and for contacting the end of a rivet during upset in a manner which will be described. The ram has a lower portion 126 as viewed in FIGS. 1–3 which is operatively connected to motive means to be described. A hydraulic cylinder designated 130 in FIG. 2 carried by the machine frame moves the ram and clamp assembly toward and away from the workpiece. Cylinder 130, commonly referred to as the upset cylinder, includes a housing 132, a piston rod 134 and fluid lines, one designated 136, for supplying and removing hydraulic fluid in a conventional manner. Housing 132 is mounted in the machine frame by means of a pair of brackets, one of which is generally designated 138, fixed to a frame supporting portion 140 and a generally horizontal frame member 142. Hydraulic fluid is supplied to and withdrawn from opposite ends of cylinder 130 by fluid lines or conduits, such as the one designated 136, to a remote fluid power source and control in a conventional manner. Piston rod 134 is fixed to the lower end of the ram and clamp assembly in a suitable manner.

There is further provided a clamping means movably connected to ram 120 and located on the ram for movement therewith toward and away from the workpiece, the clamping means including means defining a clamping surface for contacting the one side of workpiece 14 in advance of the formation on the upper end of ram 120. As shown in FIG. 1, the clamping means comprises a pair of clamping arms 152, 154 movably connected to opposite sides of ram 120. In particular each clamping arm has a lower body portion, for example portion 156 of arm 154 shown in FIG. 3, an intermediate body portion 156 of reduced size, and an upper body portion 160 which terminates in a planar clamping surface 162. Similarly, arm 152 has lower, intermediate and upper body portions and terminates in a planar clamping surface 162. The surface 162, 164 are co-planar and disposed in a plane parallel to workpiece 14. As an alternative, at least the upper portions of the arms 152, 154 adjacent surfaces 162, 164 could be merged into an integral, sleeve-shaped structure having an inner diameter of sufficient size to allow movement of the upper ram portion therethrough and with the sleeve annular end face providing a single, continuous ring-shaped workpiece contacting surface.

Each of the clamping arms 152, 154 is movably connected to ram 120 and there is provided clamping force applying means operatively connected to the ram and to the clamping arms for applying a clamping force to the workpiece when the clamping surface is brought into contact therewith. In the arrangement shown, the clamping force applying means comprises a pneumatic cylinder generally designated 170 in FIG. 2, the housing of the cylinder being fixed to and supported by rod 134 and the piston rod thereof being connected to ram 120. In particular, cylinder 170 includes a rod 172 having a fitting 174 connected to the ram lower portion 126. A relatively small degree of adjustment of ram 120 relative to clamp arms 152, 154 is provided by a set screw 176 received in base 178 and engaging fitting 174. Opposite side surfaces of ram 120 are provided with outwardly extending pins 180 received in elongated slots 182 in arms 152, 154 which slots are relativey short and are disposed parallel to drilling and riveting axis 28. As a result, cylinder 170 tends to move the ram 120 upwardly which tends to push upwardly on the clamp arms 152, 154 using the ram as an anchor point. Accordingly when ram 120 is moved by cylinder 130 toward workpiece 14, as arms 152, 154 contact the lower surface of the workpiece, further upward movement of ram 120 urges arms 152, 154 against the workpiece which imposes a force against the force of cylinder 170 thereby providing clamping force. There is also provided biasing means between the arms 152, 154 and a portion of the ram 120. In particular, a cavity 190 formed in ram upper portion 120 contains a biasing coil spring 192 disposes generally parallel to the direction of movement of ram 120. The lower end of spring 192 as viewed in FIG. 3, engages an adjustment bolt 194 threaded in ram portion 122. The upper end spring 192 engages a spring retainer element or block 196 fixed to a pin 198 which, in turn, is fixed to the arms 152 and 154. Spring 192 maintains an initial spacing between the plane of the clamp arm surfaces 162, 164 and the upper end surface of ram 120 so that surfaces 162, 164 contact workpiece 14 first during the aforementioned upward movement of ram 120.

Figures 5, 6, 7, 8, 9, 10, 11, 12:
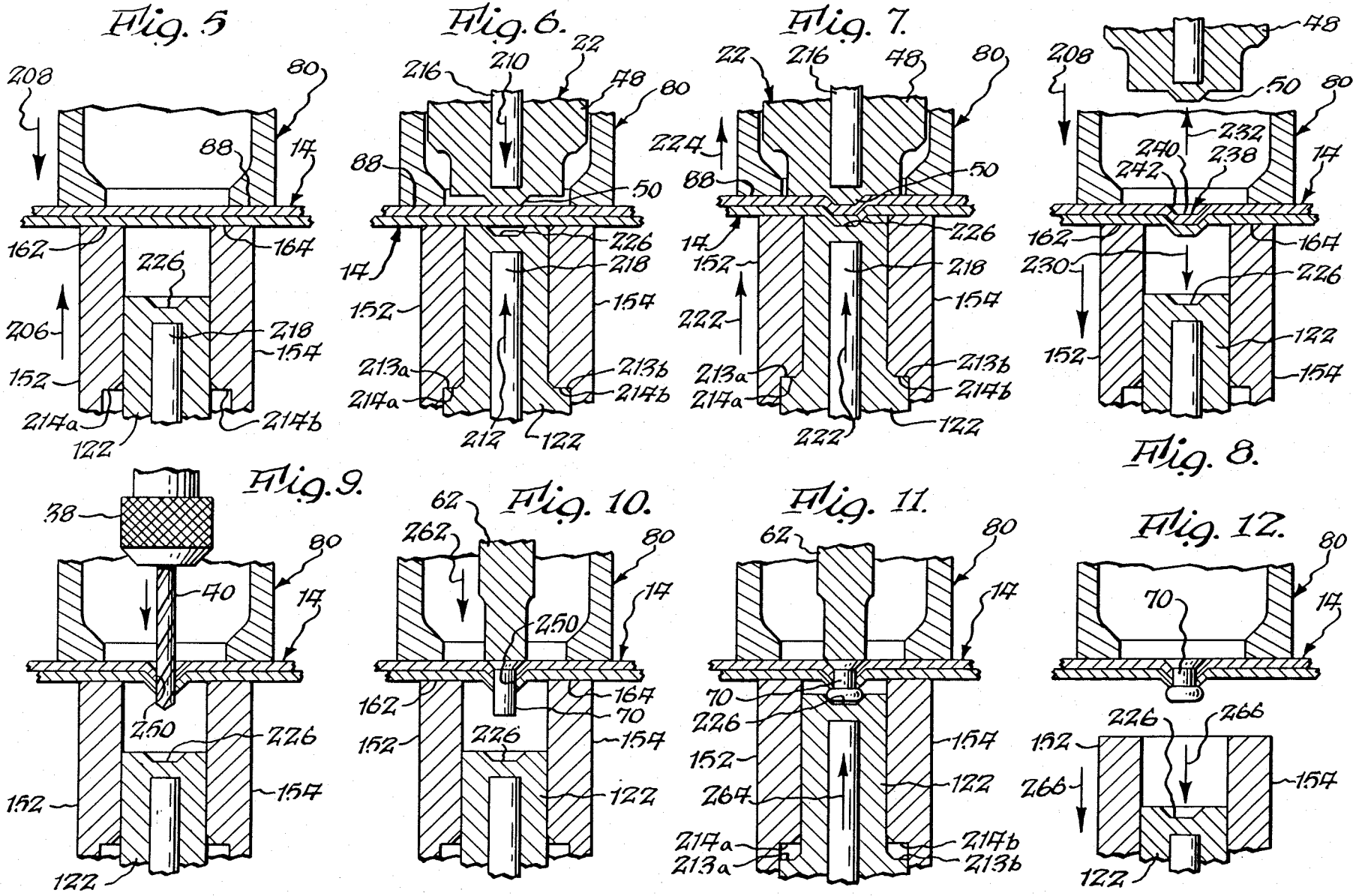
FIG. 5 is a fragmentary sectional view taken about on lines 5—5 in FIG. 3 and illustrating the clamp condition of the method and apparatus of the present invention.
FIG. 6 is a view similar to FIG. 5 illustrating the heating step thereof.
FIG. 7 is a view similar to FIG. 5 illustrating the dimpling step thereof.
FIG. 8 is a view similar to FIG. 5 illustrating the condition of the method and apparatus after dimpling.
FIG. 9 is a view similar to FIG. 5 illustrating the drilling step thereof.
FIG. 10 is a view similar to FIG. 5 illustrating the rivet insert step thereof.
FIG. 11 is a view similar to FIG. 5 illustrating rivet upset step thereof.
FIG. 12 is a view similar to FIG. 5 illustrating the unclamped condition of the method and apparatus after formation of the riveted joint.

FIGS. 5–12 illustrate operation of the apparatus of FIGS. 1–4 in performing the method according to the present invention. Referring to FIG. 5, the first step in the method of the present invention is applying clamping pressure to a defined area of the workpiece. The lower surface 88 of the pressure foot 80 is in contact with the upper surface of workpiece 14, and cylinder 130 is operated to move ram 120 upwardly thereby to place the surface 162 and 164 of the clamping arms 152 and 154, respectively, in contact with the lower surface of the workpiece 14 in a time of about 0.15 second. Clamping force applied by arms 152, 154 to the lower surface of workpiece 14 in the direction of arrow 206 is provided by cylinder 170 and further upward movement of workpiece 14 is restrained by springs 90, 92 acting on pressure foot 80 in the direction of arrow 208. This clamped condition of the workpiece thus is illustrated in FIG. 5, and in accordance with the present invention the workpiece 14 is clamped continuously during dimpling, drilling and riveting thereof. Clamping pressure is applied to the defined area of the workpiece between the pressure foot 80 and the clamping arms 152, 154.

The next step in the method of the present invention is dimpling the workpiece 14 in the defined area while the workpiece is clamped to form a dimpled recess. This is illustrated in FIGS. 6–8. The slide is moved along track 30 to move dimpling tool 22 into longitudinal alignment with the axis 28 and then cylinder 58 is operated to move dimpling tool 22 toward the workpiece in the direction of arrow 210 so that the end of anvil 48 including male die 50 just contacts the upper surface of workpiece 14 as illustrated in FIG. 6. Also, cylinder 130 is operated to move ram 120 further upwardly in the direction of arrow 212 so that the upper portion 122 contacts the lower surface of workpiece 14 as illustrated in FIG. 6. Further relative movement between ram portion 122 and clamp arms 152, 154 toward workpiece 14 is prevented by engagement between shoulders 213*a*, 213*b* on ram portion 122 and co-operating shoulders 214*a*, 214*b* on clamp arms 152 and 154, respectively. In accordance with the present invention heat is applied to the defined area of the workpiece prior to dimpling, i.e. prior to the formation of the dimpled recess. To this end, there is provided heating means carried by the dimpling means, and in the apparatus shown a heater element 216 is provided in the dimpling anvil 48 and another heater element 218 is provided in the ram upper portion 122. By way of example, in an illustrative apparatus, heaters 216 and 218 are of the cartridge type available commercially from Tempco Inc. each having a length of about two inches, a diameter of about $\frac{1}{4}$ inch and operating at an energy of about 200 watts at 220 volts. The heater cartridges are located generally centrally of the corresponding dimpling tools and the end of each heater is located inwardly from the end of the corresponding dimpling tool a distance sufficient to maintain the strength of the metal forming tool but close enough to the end to allow adequate heat transmission through the end of the corresponding tool to the workpiece. The positions of the various components of the apparatus relative to workpiece 14 during heating is shown in FIG. 6. By way of illustration, in illustrative method, the step of heating prior to dimpling is performed for a range from about 1.0 to 5.0 seconds and preferably for about 2.5 seconds and at a temperature of about 600° F. provided by heaters 216, 218 in the respective tools to provide, in turn, a temperature of about 300° F. in sheets 16, 18 of the workpiece.

Upon conclusion of the heating period, heaters 216, 218 maintain their termperature setting thermostatically and the cylinder 130 is operated to move the ram 120 and the clamp arms 152, 154 together in a direction further toward workpiece 14 as illustrated in FIG. 7 and indicated by the arrows 222. The combination of ram portion 122 and clamp arms 152, 154 thus applies a force to the one side of the workpiece in a manner causing movement of the workpiece a small distance in the direction indicated by arrow 224 during dimpling and against the biasing force or pressure foot force provided by springs 90, 92 acting on bushing 80. As shown in FIG. 7 a dimpled recess is formed in workpiece 14 as a result of the cooperative action of the male die 50 at the lower end of the dimpling anvil 48 and a female die formation 226 at the upper end of the ram. As shown in FIGS. 5–8, formation 226 is in the shape of a truncated cone having a central circular base disposed in a plane perpendicular to the direction of movement of ram portion 122 and an annular outwardly diverging side wall. Similarly, male die 50 on dimpling tool is of complementary shape in the form of a truncated cone having a central circular base disposed in a plane perpendicular to the direction of movement of anvil 28 and an annular outwardly diverging side wall. By way of example, in an illustrative method, the upward travel as viewed in FIGS. 6 and 7 of the ram portion 122, clamp arms 152, 154, workpiece 14 and pressure foot 80 is in a range from about 0.05 inch to 0.06 inch. Furthermore, the biasing force provided by the springs 90, 92 to the pressure foot 80 is in the range from about 300 to about 700 lbs. During the foregoing, both sheets 16, 18 of workpiece 14 move uniformly with the parts of the apparatus. This controls or holds the material stretch in the two sheets, i.e. the sheets stretch together during dimpling rather than stretching relative to each other. The formation of the dimpled recess occurs in a time of about 0.5 seconds whereupon cylinder 130 is operated to move ram 120 in the direction indicated by arrow 230 away from the lower surface of workpiece 14 and cylinder 58 is operated to move anvil 48 away from the upper surface of workpiece 14. The force of springs 90, 92 returns pressure foot 80 and workpiece 14 in the direction of arrow 208. The resulting dimpled recess 238 formed in the workpiece is seen in FIG. 8 and has the general shape of a truncated cone. In particular, recess 238 has a substantially circular base 240 disposed in a plane substantially parallel to the pane of workpiece 14 and has an annular, outwardly diverging sidewall 242.

The next step in the method of the present invention is drilling the workpiece 14 in the dimpled recess 238 while the workpiece is clamped to form a rivet-receiving hole. Workpiece 14 remains clamped between the lower surface 88 of pressure foot 80 and the surfaces 162 and 164 of clamping arms 152 and 154. The slide is moved along track 30 to move the dimpling tools 22 out of alignment with the axis 28 and to move the drill 20 into alignment with the axis whereupon cylinder 42 is operated to move drill 20 toward the workpiece in the direction of arrow 246 and through it for drilling the same as illustrated in FIG. 9. The extend of movement of drill 20 in this direction can be controlled by adjustable mechanical stops (not shown) associated with drill 20 and the machine frame is a conventional manner. Upon completion of the drilling, cylinder 42 is operated to move the drill 20 away from the workpiece in a conventional manner. A rivet receiving hole 250 thus is provided in base 240 of the dimpled recess 238, and typically the diameter of hole 250 is substantially equal to the diameter of base 240. The center of hole 250 is on axis 28. According to another aspect of the invention, however, the diameter of base 240 can be made greater than the diameter of hole 150 for a purpose which will be described in detail presently. In order to remove chips and other metal debris from the vicinity of hole 250 after drilling, air or other suitable gas under pressure is directed onto the upper surface of workpiece 14 adjacent hole 250 by a nozzle 254 shown in FIG. 3 located within bushing 80 directed toward the workpiece surface and connected to one end of a fluid supply line 256, the other end of which is connected to a suitable pressurized air or gas supply (not shown) in a conventional matter. The pressurized air or gas can be heated so as to be compatible with the heated workpiece and not cause any sudden cooling thereof. The wall 82 of bushing 80 can be provided with openings (not shown) to allow exit of chips and other debris blown away by the pressurized air or gas. Typically the foregoing operation occurs for a short period of time initatied upon movement of drill 20 in a direction away from workpiece 14.

The next step in the method of the present invention is inserting a rivet and upsetting the rivet in the workpiece while the workpiece is clamped to form a riveted joint. This is illustrated in FIGS. 10–12. As in the previous steps, workpiece 14 remains clamped between the lower surface 88 of pressure foot 80 and the surface 162 and 164 of clamping arms 152 and 154, respectively. The slide again is moved along track 30 to move drill 20 out of alignment with the axis 28 and to move the rivet inserting and forming tool 24 into alignment with axis 28. Prior to such movement of tool 24, a rivet was inserted or placed between the gripping fingers 64 and held therein as illustrated by rivet 70 shown in FIG. 1. During all operational cycles of the apparatus, rivets are inserted into tool 24 when it is in the position as shown in FIG. 1 and prior to being moved into alignment with axis 28.

When tool 24 is in alignment with axis 28, cylinder 72 is operated to move tool 24 toward workpiece 14 to insert rivet 70 carried fingers 64 shown in FIG. 1 into hole 250. In particular, fingers 64 are pivotally connected at the upper ends thereof to collar 68 which is axially slideable along anvil 62 against the force of spring 66 which normally urges fingers 64 into an extended position beyond the end of anvil 62 enabling them to receive and hold a rivet therebetween as shown in FIG. 1. When tool 24 is moved along axis 28 toward workpiece 14, in the direction of arrow 262 shown in FIG. 10, as rivet 70 which is held by fingers 64 spaced from the end of anvil 62 is inserted in hole 250 in workpiece, collar 68 contacts a stationary component of the apparatus (not shown) and as tool 24 is moved further toward workpiece 14, fingers 64 are pivoted outwardly a small distance to release the rivet. Then the position of tool 24 illustrated in FIG. 10 is reached with rivet 70 in hole 250, the head of the rivet received in the dimpled recess 238, and the end of anvil 62 contactng the head of rivet. At a later time when tool 24 is moved away from workpiece 14, spring 66 returns fingers 64 to their initial position as shown in FIG. 1.

Next, cylinder 172 is operated to move ram 120 toward workpiece 14 in the direction of arrow 264 indicated in FIG. 11 to a position where formation 226 engages the end of rivet 70 whereupon upset cylinder 130 then is operated to move ram 120 further toward workpiece 14 to squeeze or upset the rivet as shown in FIG. 11. Cylinder 130 provides sufficient upset force which typically is about 6000 pounds maximum. The force from ram 120 is applied through rivet 70 to anvil 62 and can be transmitted to the apparatus frame by controlled placement of a force transmitting member (not shown) between the opposite end of the anvil and the apparatus frame. Then cylinders 130 and 170 are retracted to move ram 120 and clamp arms 152, 154 away from workpiece 14 in the direction of arrows 266. The resulting riveted joint is shown in FIG. 12.

The foregoing illustrative heating temperatures and time, pressure foot force, and upset force are for riveting sheets of aluminum alloy. Die 50, at the end of dimpling anvil 48, as previously described has the shape of a truncated cone, and the angle included between the cone side wall is 100 degrees when 100 degree countersink rivets are employed. The included angle between the conical side wall of ram formation 226 is 98 degrees. These included angles are the same for different diameter rivets. By way of example, assuming about 0.15 second to clamp the workpiece 14, a heating time of about 2.5 seconds, about 0.5 second for dimpling, about 0.8 second for drilling, about 0.3 second for upset, about 0.45 second for unclamping, and about 0.5 second for each of the transfers between dimpling and drilling and between drilling and upset, the total cycle time for the method is about 5.7 seconds.

Each dimpled recess provided by the method and apparatus is located and formed in an accurate manner and without cracks and distortion in the workpiece. During formatin of the dimpled recess, workpiece material flow is controlled by preventing relative stretching of the workpiece sheets.

FIGS. 13–18 illustrate operation of the apparatus of FIGS. 1–4 in performing the method according to a further aspect of the present invention to provide a fluid-tight seal between the rivet and the workpiece. For convenience in illustration, components similar to those shown in FIGS. 1–12 are identified in FIGS. 13–18 with the same reference numerals and provided with a prime designation. The first step in this method of the present invention is applying clamping pressure to a defined area of the workpiece in a manner similar to that illustrated and described in connection with FIG. 5. Clamping pressure is applied to the defined area of the workpiece 14 between the pressure foot 80' and the clamping arms 152', 154'. Also, in accordance with this aspect of the present invention, the workpiece 14' is clamped continuously during dimpling, drilling and riveting thereof in a manner similar to the method illustrated and described in connection with FIGS. 5–12.

The next step in this method of the present invention is dimpling the workpiece 14' in the defined area while the workpiece is clamped to form a dimpled recess in a manner similar to that illustrated and described in connection with FIGS. 6–8. In particular, heat is applied to the defined area of workpiece 14' prior to dimpling, i.e. prior to formation of the dimpled recess. This is performed in a manner identical to that illustrated and described in connection with FIG. 6. Upon conclusion of the heating period, the ram portion 122' and clamp arms 152', 154' are moved together in a direction further toward workpiece 14' as described in connection with FIG. 7. The combination of ram portion 122' and clamp arms 152', 154' thus applies a force to the one side of the workpiece in a manner causing movement of the workpiece a small distance during dimpling and against the pressure foot force provided by the springs acting on bushing 80'. FIG. 13 illustrates the condition of workpiece 14' near the conclusion of this step; and as shown in FIG. 13 a dimpled recess 238' is formed in workpiece 14′ as a result of the cooperative action of the male die 50′ at the lower end of dimpling anvil 48′ and female die formation 226′ at the upper end of the ram. The resulting dimpled recess 238′ has the general shape of a truncated cone and includes a substantially circular base 240′ disposed in a plane substantially parallel to the plane of workpiece 14′ and an annular, outwardly diverging sidewall 242′. In this aspect of the method there is the same range of upward travel and range of pressure foot force as described in connection with FIG. 7. Likewise, both sheets 16′, 18′ of workpiece 14′ move uniformly with the parts of the apparatus to control or hold the material stretch in the two sheets so that the sheets stretch together during dimpling rather than relative to each other.

The next step in this method of the present invention is drilling the workpiece 14′ in the dimpled recess 238′ while the workpiece is clamped to form a rivet-receiving hole. This is performed in a manner substantially similar to that illustrated and described in conjunction with FIG. 9. However, according to this aspect of the present invention the dimpling die formations 50′ and 226′ are of a shape and size selected to provide slightly increased minor diameters of the truncated cone formations as compared to the dimpling dies 50 and 226 of the embodiment illustrated in FIGS. 5–12. In other words, the height of each truncated cone of the die formation 50′ and 226′ is decreased to increase the minor diameter thereof. As a result, the step of drilling forms a rivet-receiving hole 272 in the base 240′ of recess 238′ which is of slightly increased diameter. This, in turn, provides or defines an annular extension 274 in the form of a step or ledge between the periphery or wall of hole 272 and the recess annular wall 242. The radial width of step 274, i.e. the distance between the outer edge of hole 272 and the junction of base 240′ and wall 242′, is determined by the diameter of the rivet employed in a manner which will be described.

The next step in this method is inserting a rivet and upsetting the rivet in the workpiece while the workpiece is clamped to form a riveted joint. This is performed in a manner similar to that illustrated and described in conjunction with FIGS. 10–12. FIG. 15 illustrates rivet 70′ inserted in workpiece hole 272 and the positions of the various parts at the beginning of the upset operation with anvil 62′ contacting the head of rivet 70′ and with the formation 226′ at the end of ram portion 122′ contacting the opposite end of rive 70′. As shown in the enlarged view of FIG. 17, the provision of annular step 274 defines a small gap or clearance 278 between the annular surface of the head portion of rivet 70′ and the surface of the recess annular sidewall 242′. The annular, radially inward facing surface of step or extension 274, which is also the wall surface of hole 272, is in relatively close contact or fit with the corresponding surface portion of the rivet shank and is disposed substantially parallel to the riveting axis of the apparatus and, likewise, the longitudinal axis of rivet 70′ seated in hole 272. This together with the body of the step or extension 274 provides a means for transmission of compressive force in a radial direction relative to the riveting axis and longitudinal axis of rivet 70′ in a manner which will be described.

The upset cylinder then is operated in a manner similar to that described in connection with FIG. 11 to move ram portion 122′ further toward workpiece 14′ with sufficient upset force to squeeze or upset the rivet 70′. FIG. 16 and the enlarged view of FIG. 18 illustrate the upset rivet 70′ and resulting fluid-tight riveted joint near the conclusion of this step. During upsetting of the rivet, the annular step 274 compresses radially inwardly against the shank portion of the rivet to provide a fluid-tight seal in the riveted joint. The radial compression occurs throughout the entire thickness of step 274 against the rivet shank. As shown in FIG. 18, between the head of rivet 70′ and the enlargement 280 formed by upsetting, the outer surface 282 of the rivet shank flares slightly radially outwardly whereupon it meets an annular edge surface 284 of the enlargement 280. Also, gap 278 shown in FIG. 17 is closed with the rivet head firmly contacting recess surface 242′ and with the end surface of rivet 70′ flush with the workpiece surface as in the riveted joint shown in FIG. 12. After upsetting of the rivet, the cylinders are operated to move the ram portion 122′ and clamp arms 152, 154′ away from the workpiece 14′.

As previously mentioned, the radial width of annular step 274, i.e. the distance between the outer edge of hole 272 and the junction of base 240′ and wall 242′, is determined by the diameter of the rivet being used. By way of example, with $\frac{1}{8}$ inch diameter rivets the width of step 274 is about 0.008 inch, with 5/32 inch rivets step 274 is about 0.010 inch wide, with 3/16 inch rivets a 0.012 inch step, and with $\frac{1}{4}$ inch rivets a step width of 0.016 inch. Also, the angles for dies 50′ and 226′ are the same as those for dies 50 and 226 previously described.

By way of further illustration the following example demonstrates the effectiveness of the resulting fluid-tight rivet joint. A test panel was made comprising a skin and a pair of stringers riveted thereto by means of two rows of rivets. Each riveted joint was made according to the method of FIGS. 13–18. A fitting was installed through the panel in the riveted area, the fitting being open on the skin side and having a hose connected thereto on the stringer side of the panel. The panel then was placed on a horizontal support with the skin side facing upwardly and with the stringer side exposed to atmospheric pressure. A bell jar having a peripheral rubber jacket then was placed on the skin side of the panel with the riveted joints and fitting opening enclosed within the bell jar. Water then was introduced into the lower region of the bell jar to a level covering the riveted joints but not the fitting opening. The hose leading from the fitting was connected to a vacuum pump equipped with a manometer. The pump was operated to evacuate the interior of the bell jar and a vacuum was drawn down to 500 m.m. of mercury which corresponds to 9.6 psi. There was no evidence of leakage, i.e. no air bubbles, through the test panel. The test panel had 16 rivets, rivet pitch was 11/16 inch, and rivet diameter was 5/32 inch. The skin was 0.032 inch thick, 14 inches by 18 inches and 2024T3 aluminum. Each stringer was a " 50" T section and the stringers were spaced 5 9/16 inches apart.

It is therefore apparent that the present invention accomplishes its intended objects. While embodiments of the present invention have been described in detail, this is for the purpose of illustration, not limitation.

We claim:

1. Apparatus for dimpling, drilling and riveting a workpiece having one side and an opposite side comprising:

(a) a frame;

(b) dimpling means carried by said frame for forming a dimpled recess having a wall in said workpiece and comprising a first dimpling tool movable toward and away from said one side of said workpiece, said first dimpling tool having a solid end in the form of a die for contacting the workpiece and havig a shape of a truncated cone having a central substantially circular base defining a minor diameter disposed in a plane substantially perpendicular to the direction of movement of said tool and an annular outwardly diversing side wall and a second dimpling tool movable toward and away from said opposite side of said workpiece, said second dimpling tool having a solid end in the form of a die for contacting said workpiece and having a shape complementary to the end of said first dimpling tool;

(c) drilling means carried by said frame and adapted to be moved toward and away from said workpiece for drilling a rivet-receiving hole in the dimpled recess, said drilling means including a drill bit having a given diameter;

(d) riveting means for inserting a rivet in the rivet receiving hole and upsetting the rivet; and (e) the minor diameter of the truncated cone on said end of said first dimpling tool being slightly greater than the diameter of said drill bit so that after said drilling means provides said rivet-receiving hole an annular extension results between the rivet receiving hole and said wall of the dimpled recess and said riveting means during upsetting of the rivet provides a radial compresssion of said workpiece material in said extension to provide a fluid tight seal between said workpiece and the rivet.

2. Apparatus according to claim 1, further including means for heating said workpiece prior to dimpling thereof.

3. Apparatus according to claim 2, wherein said heating means is carried by said dimpling means.

4. Apparatus according to claim 3, wherein said heating means comprises a heater element located in at least one of said dimpling tools.

5. Apparatus according to claim 3, wherein said heating means comprises a heater element in each of said dimpling tools.

6. Apparatus according to claim 1, further including means for clamping said workpiece continuously during dimpling, drilling and riveting thereof at a location adjacent and around the location on said workpiece to be dimpled, drilled and riveted.

7. Apparatus according to claim 6, wherein said clamping means comprises:

(a) a pressurefoot having a surface adapted to contact said one side of said workpiece at a location adajcent and around the location on said workpiece to be dimpled, drilled and riveted (b) biasing means operatively connected between said pressure foot and a frame of the apparatus for applying a biasing force to said pressure foot;

(c) a clamp member having a surface adapted to contact said opposite side of said workpiece at a location adjacent and around the location on said workpiece to be dimpled, drilled and riveted.; and (d) motive means operatively connected to said clamp member and to said frame for moving said clamp member into contact with said workpiece and moving said workpiece into contact with said pressure foot and then moving said clamp member and said pressure foot with said workpiece therebetween against the force of said biasing means during dimpling.

* * * * *

UNITED STATES PATENT AND TRADEMARK OFFICE

CERTIFICATE OF CORRECTION

PATENT NO. : 4,858,289

DATED : August 22, 1989

INVENTOR(S) : Thomas H. Speller, Sr.

It is certified that error appears in the above-identified patent and that said Letters Patent is hereby corrected as shown below:

Column 13, Claim 1, line 4, "havig" should be --having--.

Signed and Sealed this

Ninth Day of July, 1991

*Attest:*

HARRY F. MANBECK, JR.

*Attesting Officer*

*Commissioner of Patents and Trademarks*